United States Patent [19]

King

[11] Patent Number: 4,715,423

[45] Date of Patent: Dec. 29, 1987

[54] COMPOSITE BREAK RING METHOD

[75] Inventor: Patrick D. King, Rantoul, Ill.

[73] Assignee: Flo-Con Systems, Inc., Champaign, Ill.

[21] Appl. No.: 6,793

[22] Filed: Jan. 27, 1987

Related U.S. Application Data

[62] Division of Ser. No. 795,837, Nov. 7, 1985.

[51] Int. Cl.[4] ..... B22D 19/00

[52] U.S. Cl. ..... 164/98; 164/75; 264/81; 249/114 R

[58] Field of Search ..... 164/6, 9, 14, 19, 28, 164/34, 75, 98; 249/61, 62, 57, 114 R, 137; 264/60, 81, 255

[56] References Cited

U.S. PATENT DOCUMENTS

| | | | |
|---|---|---|---|
| 3,642,058 | 2/1972 | Webbere et al. . | |
| 3,726,333 | 4/1973 | Goodrich et al. . | |
| 4,289,447 | 9/1981 | Sterman et al. | 264/81 |

*Primary Examiner*—Nicholas P. Godici
*Assistant Examiner*—G. M. Reid
*Attorney, Agent, or Firm*—Jack E. Dominik

[57] ABSTRACT

A method of forming a break ring by providing a frame having a cross-section complementary to the exterior portion of the break ring, and the frame having an interior base of the cross-section of the break ring which will be in contact with the molten metal in the continuous caster is disclosed. The frame is thereafter filled with plasma sprayed boron nitride, silicon nitride, or whatever material is to immediately contact the metal in the horizontal continuous caster. This is subsequently followed by the spraying of a substrate onto the skin of the break ring, whereafter the body portion is finally filled. Detonation gun-type spraying is also contemplated, but a plasma gun forms a superior coating and gives more flexibility. Finally, the body is formed interiorly of the break ring further by plasma application or by casting. In one option, a cooling tube is laid into the body portion. The break ring itself is characterized by a continuous construction with a skin preferably of boron nitride or related materials, a substrate of zirconium oxide or aluminum oxide or silicon carbide, and a body of copper or equivalent materials. Optionally the body contains a coolant tube which can be constantly flushed during the course of casting and maintain the break ring at a temperature below that of the metal being cast.

3 Claims, 7 Drawing Figures

COMPOSITE BREAK RING METHOD

CROSS-REFERENCE-TO-RELATED APPLICATION

The present application is a divisional application of Ser. No. 795,837 filed Nov. 7, 1985 by the same inventor herein and allowed on Dec. 9, 1986.

FIELD OF THE INVENTION

The present invention relates to horizontal continuous casters for the casting of metal, and more specifically to a method relating to a component of such horizontal casters.

SUMMARY OF THE PRIOR ART

Horizontal continuous casters have a long history, dating back to U.S. Pat. No. 3,023 issued in 1843. More recently, however, General Motors U.S. Pat. Nos. 3,642,058 and 3,726,333 exemplify an upgraded state of the art, and disclose horizontal continuous casters useful in making billets both round in cross-section and rectangular. Companies active in the field include technica-Guss GmbH of Wurzburg, Germany; Mannesmann Demag Huttentechnik in Duisburg, Germany; and Steel Casting Engineering Limited of Orange, Calif. Critical to a horizontal continuous caster is an element known as the "break ring" which immediately precedes the mold as the metal is poured from the holding tundish. The break ring is slightly smaller than the mold and defines the meniscus in horizontal continuous casting molds and stops the crystallization front from growing toward the refractory of the tundish or slide gate preventing a shell growing problem. Most continuous casting break rings are formed of a boron nitride. They may also be formed of silicon nitride, aluminum oxide mixtures with graphite, admixtures of silicon nitride and boron and mixtures of boron and aluminum nitride.

According to the current state of the art, the break rings are formed from a block of material. Boron nitride machines readily with conventional machining equipment, but is quite expensive. Since it is a ring, the central area is sacrificed and becomes waste with little likelihood of reclamation. Furthermore, because the current state of the art break rings must be machined from a single block of material, there is a size limitation as to the dimensions of the break rings.

Particularly where on wants a break ring and a mold to mold continuous sheets for twenty-four to forty-eight inches wide, a break ring of similar cross-section (slightly less) is required. Such as not capable of production according to the current state of the art.

SUMMARY OF THE INVENTION

The present invention relates to the method of forming a break ring by providing a frame having a cross-section complementary to the exterior portion of the break ring, and the frame having an interior base of the cross-section of the break ring which will be in contact with the molten metal in the continuous caster. The frame is thereafter filled with plasma sprayed boron nitride, silicon nitride, or whatever material is to immediately contact the metal in the horizontal continuous caster. This is subsequently followed by the spraying of a substrate onto the skin of the break ring, whereafter the body portion is finally filled. Detonation gun-type spraying is also contemplated, but a plasma gun forms a superior coating and gives more flexibility. Finally, the body is formed interiorly of the break ring further by plasma application or by casting. In one option, a cooling tube is laid into the body portion. The break ring itself is characterized by a continuous construction with a skin preferably of boron nitride or related materials, a substrate of zirconium oxide or aluminum oxide or silicon carbide, and a body of copper or equivalent materials. Optionally the body contains a coolant tube which can be constantly flushed during the course of casting and maintain the break ring at a temperature below that of the metal being cast.

It is a principle object of the present invention to provide a method for forming a break ring useful in horizontal continuous casting without waste of material, and continuous in configuration with transitions between its metallic body from material to material. The method also contemplates an alternative of burying a cooling tube within the body of the break ring. A chief advantage flowing from this method is the capability of forming a break ring of almost endless width and relatively narrow depth where slab casting is desired.

A further object of the present invention is to provide a method for forming break ring which is efficient and effective in operation and gives long life, in addition to economical cost.

BRIEF DESCRIPTION OF THE DRAWINGS

Further objects and advantages of the present invention will become apparent as the following description of an illustrative embodiment proceeds, taken in conjunction with the accompanying drawings, in which.

DETAILED DESCRIPTION OF PREFERRED EMBODIMENTS

The method

Figure 1:
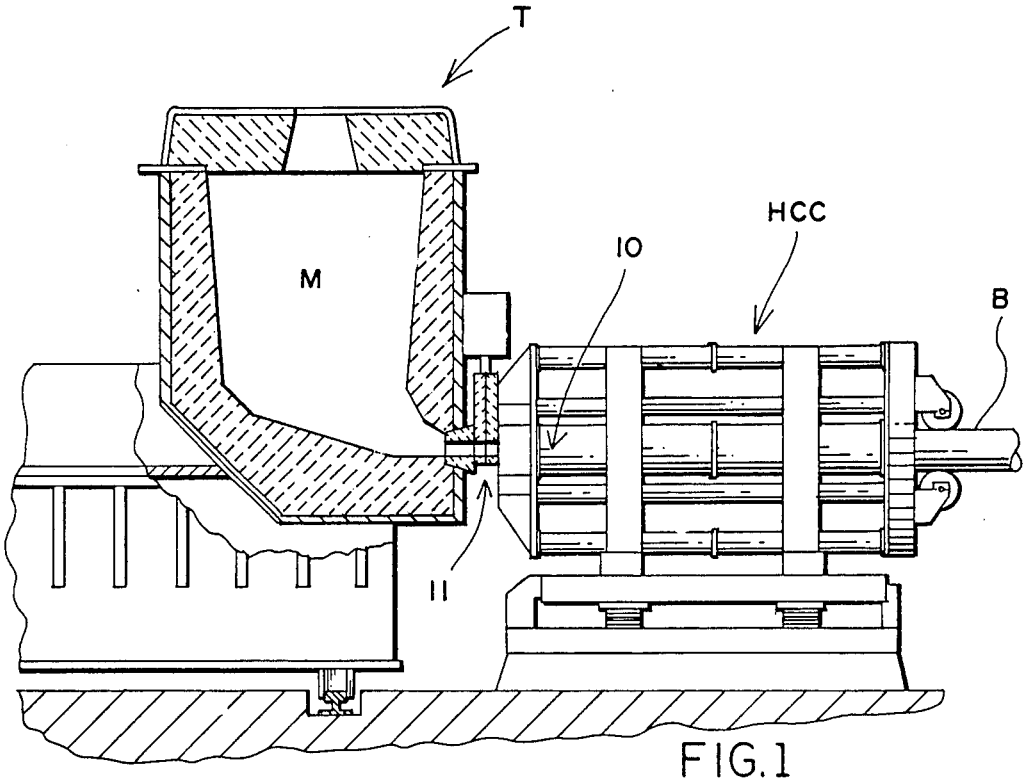
FIG. 1 is a front elevation of a horizontal continuous caster taken in longitudinal cross-section illustrating the principal elements of such a caster.

The method of the present invention will be best understood in the environment in which it finds itself. Turning now to FIG. 1, it will be seen that a horizontal continuous caster HCC is provided to produce a billet B by pouring metal M from a tundish T. Unlike the vertical continuous casters, the horizontal continuous caster has a mold which does not vibrate. The horizontal continuous caster relies on a plurality of pulling elements to grasp the billet B and reciprocatingly draw the same through the mold while the mold is fed by the metal M in the tundish T.

Figure 2:
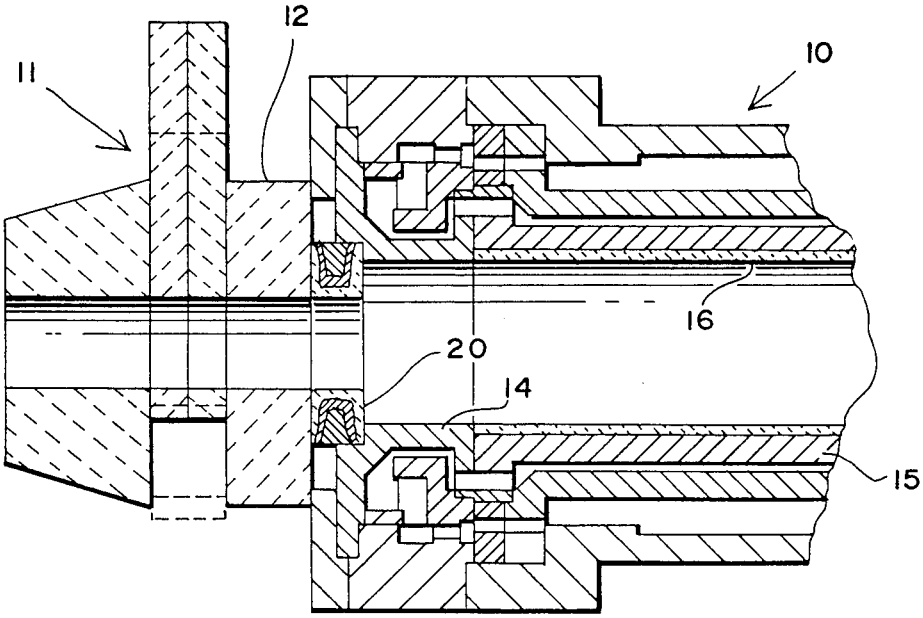
FIG. 2 is a longitudinal section of an illustrative break ring and mold construction.

Turning now to FIG. 2, it will be seen that the mold assembly 10 includes a valve 11 for shutting off the flow of metal M from the tundish T, or opening the same. When the valve 11 is open, the metal M first contacts the ring 12 which is normally a ziron silicate ring. It serves to accomplish the initial transition. The metal continues to flow through the ziron silicate ring 12 into the first mold portion 14, and thereafter to the second mold portion 15. A graphite insert 16 may be placed inside the interior portion of the copper molds 14, 15.

In accordance with the invention, a break ring 20 is provided between the ziron silicate ring 12, and the mold portions 14, 15. The function of the break ring is as set forth in the Summary, primarily to prevent crystalline growth going rearwardly into or toward the tundish, and to permit an orderly transition of the metal into the mold 15, 16. As will be specifically noted in FIG. 2, the break ring cross-section as well as that of the zircon silicon ring 12 is of lesser magnitude that that of the mold assembly itself.

Figure 3:
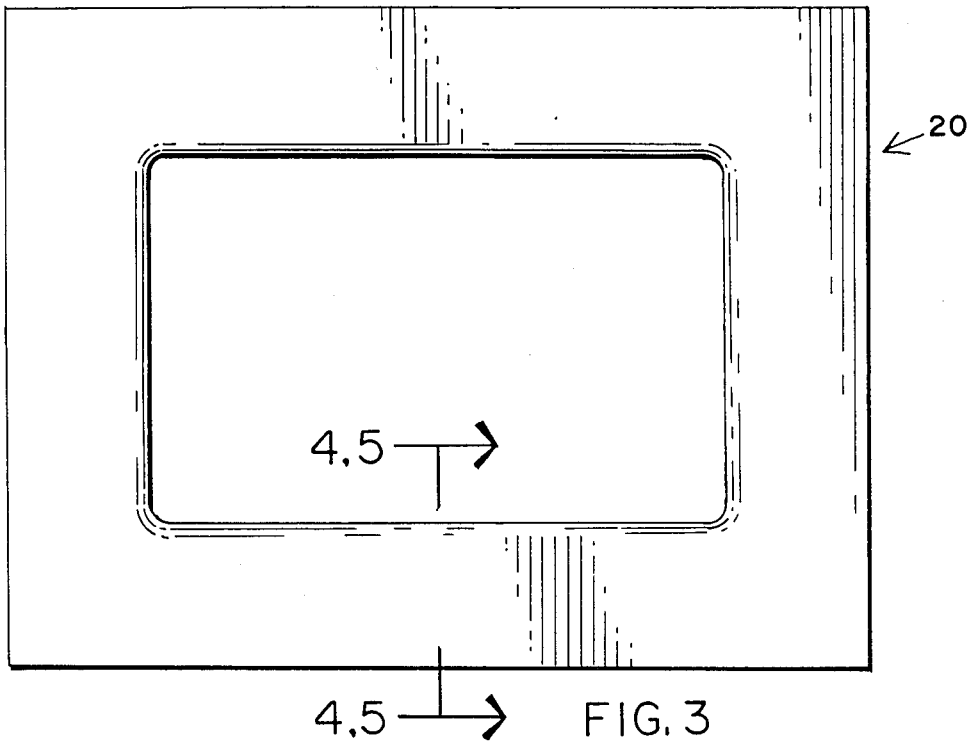
FIG. 3 is a front elevation of a typical rectangular break ring.
Figure 4:
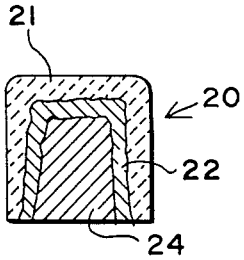
FIG. 4 is a transverse sectional view of the break ring of FIG. 3 taken along section line 4—4 of FIG. 3.
Figure 5:
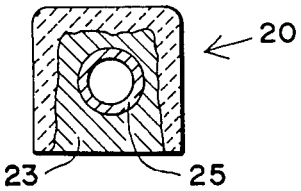
FIG. 5 is an alternative cross-section showing a coolant tube interiorly of the break ring.

Turning now to FIG. 3, it will be seen that the break ring 20 is rectangular in cross-section. As shown in FIG. 4, the break ring 20 has a boron nitride skin 21 which may be also formed of silicon nitride, or a boron nitride combination with aluminum nitride. It is formed of a sufficient depth to accommodate the wear of the break ring 20 until such time as it requires removal from the horizontal continuous caster. A second substrate 22 is formed interiorly of the break ring and may be of zirconium oxide, aluminum oxide, or silicon carbide. This skin 22 as seen in FIG. 4 forms a barrier between the outer skin and the body 24 of the break ring. The body 24 may be copper or aluminum oxide. As shown alternatively in FIG. 5, a coolant tube 25 may be burried in the body 24 to provide for continuous cooling.

Figure 7:
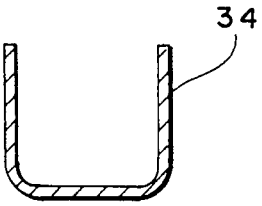
FIG. 7 is a transverse view of a frame member of the mold taken along section line 7—7 of FIG. 6.
Figure 6:
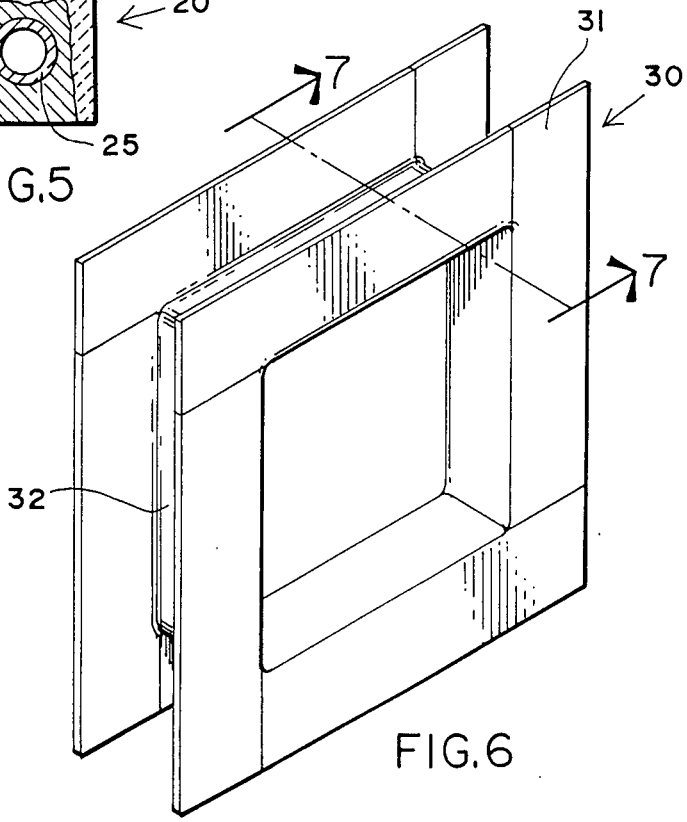
FIG. 6 is a perspective view of a mold useful in forming the break ring of FIG. 3.

The method contemplates first the formation of a mold 30 as shown in FIG. 6. The mold essentially has outlying frame plates 31, and a base 32 which forms the interior portion of the break ring 20. In accordance with the method. a plasma gun is employed to lay-up the layers of skin 21, 22 and the body 24. A detonation gun is also contemplated for the same purpose. What is important is that the break ring 20 be formed as a unitary body interiorly of the mold 30. As seen in FIG. 7, the mold cross-section 34 is generally U-shaped, and may be made from an extrusion to minimize the cost of the mold 30. The mold 30 may be disassembled at its joint portions after the break ring 20 is formed, or it may be etched away or, when formed of a metal with a lower melting point than that of the break ring 20, melted away. The dimensioning of the mold 30 is intended to accommodate any shrinkage of the break ring due to its formation, and to provide the ultimate dimensional characteristics of the particular unit. The break rings are normally press-fitted into the horizontal continuous caster.

In summary, the break ring 20 is characterized by a smooth exterior skin 21 which is endless in nature due to its formation in a single frame. A secondary skin 22 or substrate 22 separates the exterior skin 21 from the interior body 24. The interior body 24 may be cast into place or applied with a plasma gun or detination gun.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification, and appended claims.

What is claimed is:

1. The method of forming a composite break ring comprising the steps of, forming a ring shaped mold having a frame body portion with a U-shaped cross-section the interior portion of which is the bottom of the U and a base defining the interior dimension of the intended break ring, temperature heating of a material to form the skin of the break ring and spraying the same interiorly of the mold, temperature heating of the substrate skin beneath the first skin and applying the same in intimate contact to the first skin to thereby form an interior shell of the break ring, and filling the balance of the body of the break ring with a third material.

2. In the method of claim 1 above, the additional step of forming the subject mold of a material which can be disintigrated, disintigrating the subject mold after the break ring is formed to thereby leave the break ring itself.

3. In the method of claim 1 above, positioning a coolant tube interiorly of the body prior to forming the body portion.

* * * * *